United States Patent [19]

Bowman et al.

[11] Patent Number: 4,594,475

[45] Date of Patent: Jun. 10, 1986

[54] ELECTRICAL BUSHING HAVING A CONVERTIBLE CENTRAL CONDUCTOR

[75] Inventors: Dennis C. Bowman; James L. Marlowe, both of Bells, Tenn.

[73] Assignee: Westinghouse Electric Corp., Pittsburgh, Pa.

[21] Appl. No.: 637,373

[22] Filed: Aug. 3, 1984

[51] Int. Cl.[4] ..... H01B 17/26

[52] U.S. Cl. ..... 174/152 R; 174/12 BH

[58] Field of Search ..... 174/11 BH, 12 BH, 14 BH, 174/15 BH, 16 BH 18, 31 R, 75 D, 152 R, 153 R, 167, 142, 143

[56] References Cited

U.S. PATENT DOCUMENTS

| | | | |
|---|---|---|---|
| 1,834,379 | 12/1931 | Burr et al. | 174/167 |
| 2,099,666 | 11/1937 | Terpak | 174/12 BH |
| 2,195,003 | 3/1940 | Danvers | 174/152 R X |
| 2,525,444 | 10/1950 | Bowers | 174/12 BH X |

FOREIGN PATENT DOCUMENTS

| | | | |
|---|---|---|---|
| 356505 | 10/1961 | Switzerland | 174/143 |

*Primary Examiner*—Laramie E. Askin

*Attorney, Agent, or Firm*—L. P. Johns

[57] ABSTRACT

An electrical insulating bushing for conversion between various current ratings and characterized by a tubular column including an insulating portion, a tubular conductor extending through the column and connected to terminals at the top and bottom of the column, and another conductor disposed within the tubular conductor and connected to the terminal at the top of the column. In order to convert the bushing to a different current rating, a replacement conductor is provided which can be substituted for the conductor within the tubular conductor. The replacement conductor and tubular conductor are electrically connected together in spaced alignment near the bottom terminal by a conductive annulus and a coil spring.

5 Claims, 3 Drawing Figures

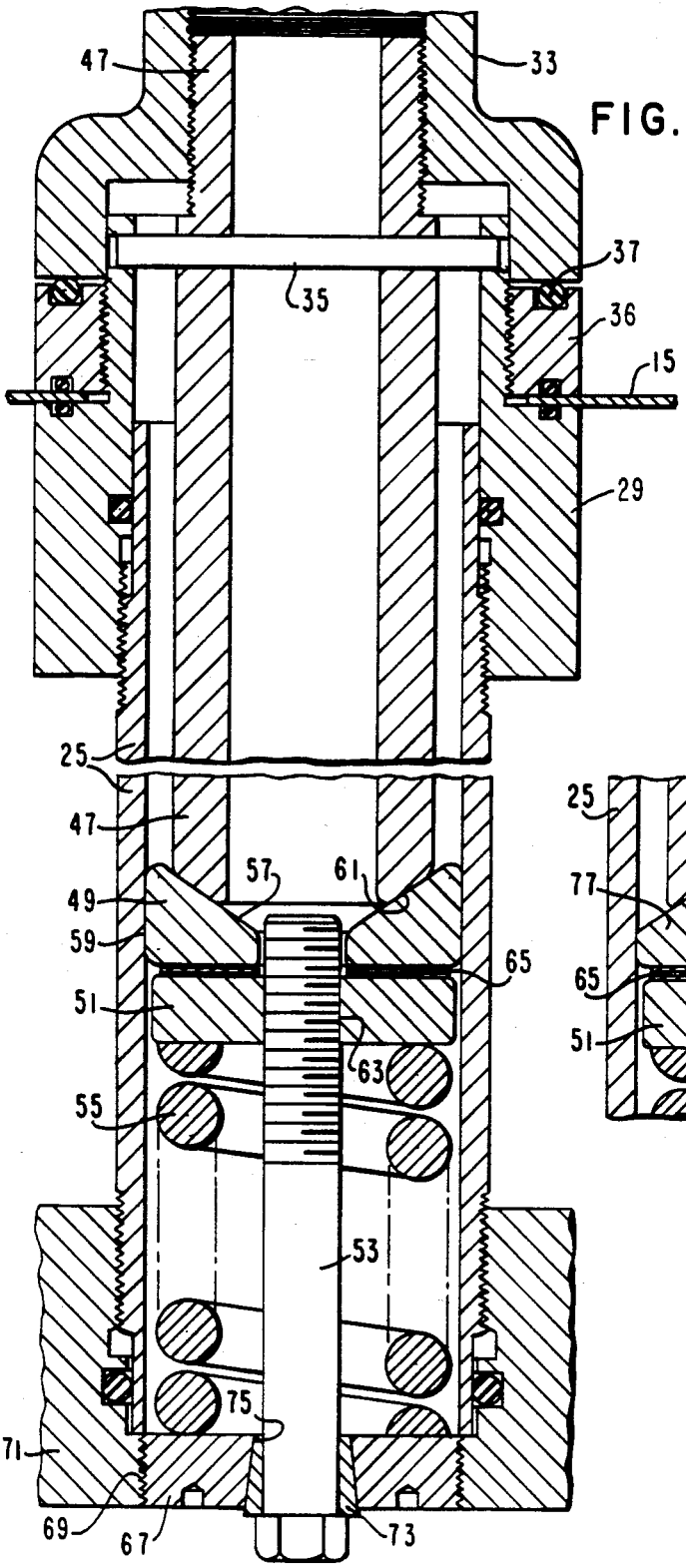
FIG. 2
FIG. 3
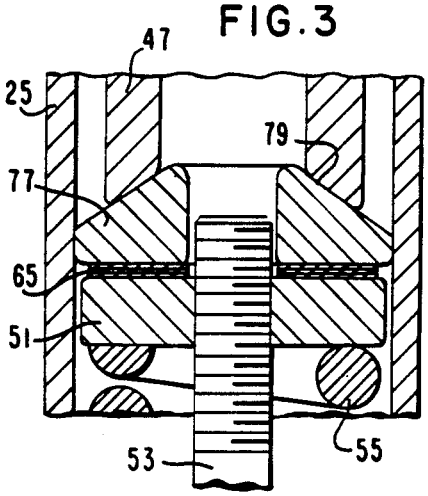

ELECTRICAL BUSHING HAVING A CONVERTIBLE CENTRAL CONDUCTOR

BACKGROUND OF THE INVENTION

1. Field of the Invention

This invention relates generally to electrical insulating bushings and, more particularly, to such bushings having interchangeable conductors for various current ratings.

2. Description of the Prior Art

The apparatus bushing industry has conventionally used a single current-carrying element as the electrical path through a bushing, such being a result of restrictions imposed by skin effect. The non-uniformity of current distribution due to the frequency of the current is called "skin effect". The net result of the skin effect for 60 Hertz was to limit the practical conductors to a small diameter metal rod up to approximately 1 inch diameter, or a metal tube with a wall thickness of approximately one-half inch. As the current capacity requirements increased, a larger diameter tube was employed to provide a larger cross section for the current path.

Associated with the foregoing is the problem of holding in stock a supply of bushings for the several and various current ratings required by electrical customers. As a result, a costly procedure for maintaining and accounting for bushings was required for the varying current ratings.

SUMMARY OF THE INVENTION

In accordance with this invention, an electrical insulating bushing is provided which is adapted for conversion between various current ratings and it comprises a tubular insulating column, a tubular conductor within the column, another conductor disposed inside the tubular conductor within the column, a first terminal at one end of the column for connection with corresponding ends of the two conductors, the conductor inside the tubular conductor being detachably connected to the terminal, a replacement conductor for replacement of the conductor within the tubular conductor upon removal of the same, and alignment means for holding the tubular and replacement conductors spaced from each other and in electrical contact.

The advantage of the device of this invention is that it enables the provision of an electrical insulating bushing which satisfies the limitations imposed by the skin effect and is convertible to conform to requirements of various current ratings.

BRIEF DESCRIPTION OF THE DRAWINGS

FIG. 2 is a sectional view of the bushing of FIG. 1 which has been converted for use at another current rating; and FIG. 3 is a fragmentary vertical sectional view of another embodiment of the invention.

DESCRIPTION OF THE PREFERRED EMBODIMENTS

Figure 1:
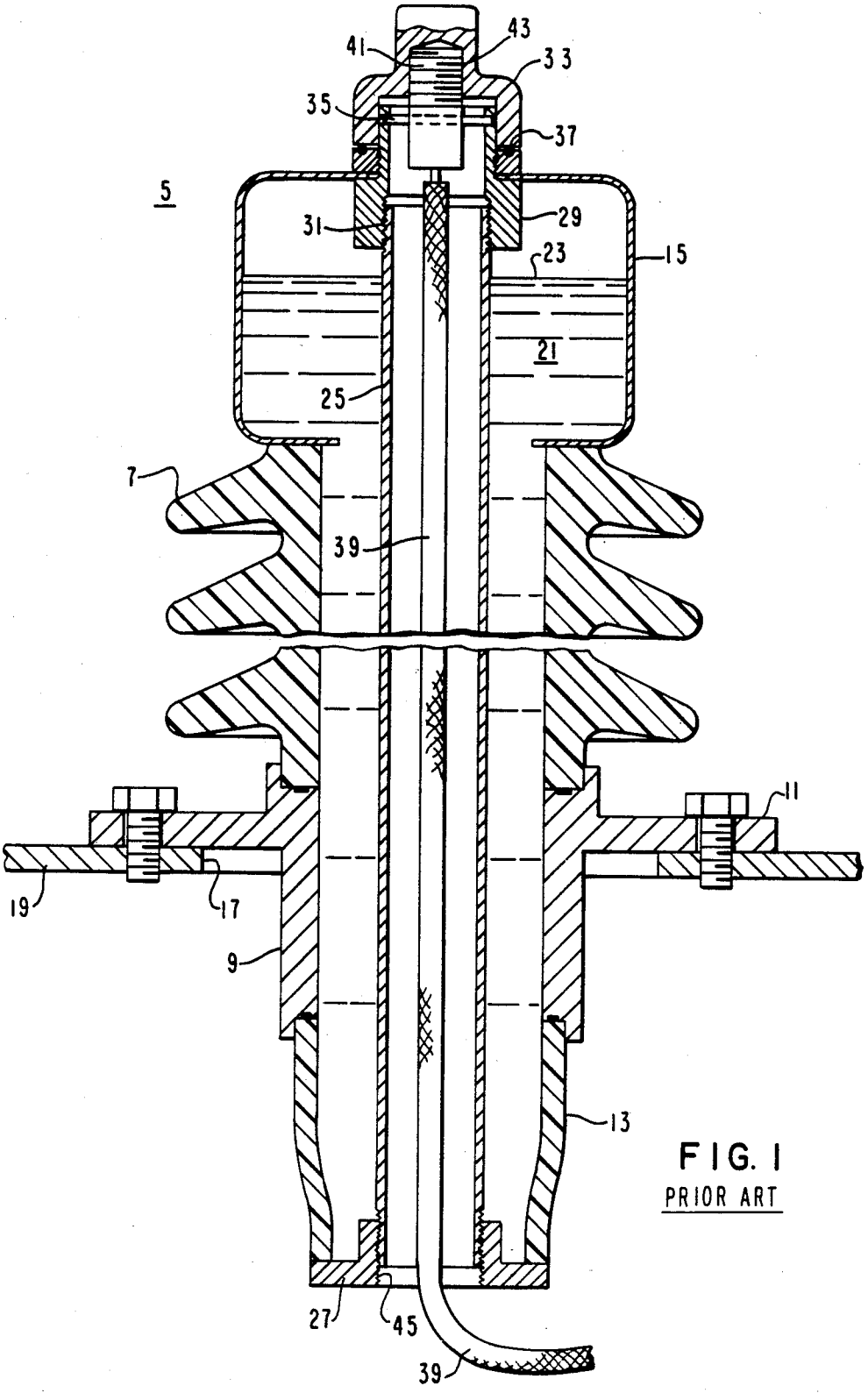
FIG. 1 PRIOR ART
FIG. 1 is a vertical sectional view of an electrical insulating bushing constructed in accordance with the teachings of the prior art.

Throughout the following description, identical reference numbers are used to refer to the same components in all figures of the drawings.

An electrical insulating bushing is generally indicated at 5 and is employed on a tank of an electrical apparatus, such as a transformer, circuit breaker, or the like, for connecting leads from the electrical apparatus contained within the tank to an exterior electrical circuit. The bushing 5 comprises an outer shell or tubular housing 7, a mounting annulus 9 having a flange 11, a lower shell or housing 13, and a bushing bowl 15. The tubular housing 7 is composed of a dielectric material, such as an epoxy resin or porcelain, and is mounted on the metallic annulus 9 which extends through an opening 17 in a tank wall 19 and where it is secured in place in a conventional manner such as by a plurality of spaced bolts extending through the mounting flange 11. The lower shell or housing 13 is likewise composed of a dielectric material, such as an epoxy resin or porcelain, and is secured in a fluid-tight manner to the lower end of the annulus 9.

The bushing bowl 15 is mounted in a fluid-tight manner on the upper end of the tubular housing 7 where the lower wall of the bowl is open and communicates with the interior of the tubular housing 7. An insulating or dielectric fluid 21 occupies the interior of the bushing 5 and preferably has an upper level 23 within the bowl 15 into which the fluid is free to expand or contract with variations in the temperature of the fluid.

A tubular conductor 25 is coextensive with the bushing 5 and extends from the lower end of the housing 13 to the upper surface of the bushing bowl 15. The lower end of the conductor 25 is secured to a terminal-closure plate 27 which is secured against the lower end of the housing 13 in a fluid-tight manner. The upper end of the conductor 25 is secured to a fitting 29 in a suitable manner such as a threaded joint 31. The fitting 29 extends through an opening in the top surface of the bushing bowl where it is secured by a nut 36 that, in turn, is disposed below a metallic top terminal 33 in a fluid-tight manner such as by an O-ring 37.

As shown in FIG. 1, a draw lead or flexible cable 39 extends through the tubular conductor 25. The upper end of the draw lead 39 is secured to a conductor pin 41 that is connected to the top terminal 33 in a suitable manner such as by a threaded joint 43.

The draw lead 39 extends from the conductor pin 41 downwardly through the tubular conductor 25 and through an opening 45 in the plate 27 (FIG. 1). The draw lead is used for relatively low or fixed currents.

In accordance with this invention, to up-rate the current ratings of the bushing 5, the draw lead 39 is removed by disconnecting the top terminal 33 and removing the locking pin 35.

As shown in FIG. 2, a replacement conductor 47 is disposed within the tubular conductor 25 to replace the draw lead 39. The dimensional characteristics of the conductor 47 are dictated by the current ratings required. For that purpose, the conductor 47 may be tubular, solid, or may be comprised of a plurality of separate conductors. The preferred configuration of the conductor 47 is tubular as shown in FIG. 2. The upper end of the conductor 47 is connected to the fitting 29 by the pin 35. Thus, the tubular conductors 25, 47 are connected at their upper ends to a top terminal.

Likewise, the lower ends of the conductors 25, 47 are electrically interconnected by means including an annular wedge 49, an annulus 51, and a compression spring 55. The wedge 49 includes an inclined surface 57 which extends downwardly and inwardly toward the axis of the bushing 5, or at an angle to the tubular conductor 25. A peripheral surface 59 is preferably in electrical contact with the inner surface of the tubular conductor 25. The lower end of the conductor 47 is preferably inclined at 61 at an angle corresponding to that of the inclined surface 57 in order to provide good electrical contact. Moreover, the wedge 49 retains the conductor 47 in spaced relation and concentrically of the tubular conductor 25. After the bushing has been completely assembled, a bolt 53 and a wedged washer 73 are removed to release the spring 55.

The annulus 51, being mounted in a suitable manner such as a threaded joint 63 on the bolt 53, supports the wedge 49 from which it is preferably separated by at least one washer 65. The spring 55 extends between the annulus 51 and a closure plate 67 which is secured in a fluid-tight connection such as a threaded joint 69 within a lower terminal 71. The wedged washer 73 is preferably seated within an opening 75 of the closure 67 for holding the lower end of the bolt 53 in place. Thus, like the upper ends of the conductors 25, 47, the lower ends are likewise in good electrical contact through the annular wedge 49 as well as the annulus 51, the spring 55, and the closure plate 67.

Another embodiment of the invention is shown in FIG. 3 in which an annular wedge 77 is disposed between the annulus 51 and the lower end of the conductor 47. The wedge 77 differs from the wedge 49 in that an inclined surface 79 extends radially downwardly and outwardly from the axis of the bushing 5, but is otherwise similar in function and composition to that of the wedge 49; that is, the wedge 77 maintains the conductors 25, 47 in spaced relation and provides electrical conduction between the tubes near the terminal 71.

In conclusion, the electrical bushing of this invention provides convertibility of conductors whereby a required current rating is achieved by changing conductor characteristics within the bushing, thereby avoiding the need for maintaining a supply of separate bushings for various current ratings.

What is claimed is:

1. An electrical insulating bushing comprising:

a tubular column including an insulating portion;

a tubular first conductor within said column;

a second conductor within the first conductor;

a first terminal at one end of the column connecting with corresponding ends of the first and second conductors;

a second terminal at the other end of the column and including means for electrically connecting the first and second conductors and comprising an annulus having a first surface contacting the first conductor and a second surface contacting the second conductor, and the second surface being inclined at an angle to the axes of the first and second conductors; and pressure means for biasing the annulus against the second conductor so as to effect spaced alignment between the conductors.

2. The bushing of claim 1 in which the second conductor is a tube.

3. The bushing of claim 2 in which the second conductor has an inclined end surface in abutment with the inclined surface of the annulus.

4. The bushing of claim 3 in which the inclined surfaces are inclined inwardly toward the axes of the conductors.

5. The bushing of claim 4 in which the pressure means comprises a coil spring between the annulus and the second terminal at the end of the column.

* * * * *